United States Patent [19]

Hickey

[11] 4,306,665

[45] Dec. 22, 1981

[54] CONTAINERS HAVING A FLEXIBLE COVER SEALABLE TO A RIGID BASE

[75] Inventor: Christopher D. D. Hickey, Esher, England

[73] Assignee: Airflex Containers Limited, Ashford, England

[21] Appl. No.: 147,313

[22] Filed: May 6, 1980

[30] Foreign Application Priority Data

May 22, 1979 [GB] United Kingdom ..... 17821/79

[51] Int. Cl.[3] ..... B65D 53/00

[52] U.S. Cl. ..... 220/232; 277/34.3; 150/0.5; 150/52 R; 206/600

[58] Field of Search ..... 220/232; 150/0.5, 52 R; 206/497, 600; 277/34, 34.3, 34.6

[56] References Cited

U.S. PATENT DOCUMENTS

| | | | |
|---|---|---|---|
| 3,221,921 | 12/1965 | Silverman | 220/232 |
| 3,240,038 | 3/1966 | Schwegler | 220/232 X |
| 3,501,868 | 3/1970 | Ganzinotti | 277/34.3 X |
| 4,114,668 | 9/1978 | Hickey | 150/0.5 |
| 4,121,732 | 10/1978 | Hickey | 206/600 X |
| 4,140,237 | 2/1979 | Hickey | 150/0.5 X |

*Primary Examiner*—Robert S. Ward, Jr.
*Attorney, Agent, or Firm*—Young & Thompson

[57] ABSTRACT

A container of the kind having a rigid base to which a flexible cover is sealed by means of an inflatable sealing tube is formed with a rigid support plate as part of the base, the support plate being carried on a support member having an upwardly-extending pressure wall surrounding and facing inwardly towards the edge of the plate. The pressure wall extends upwardly from below the level of the edge of the plate to above that level and the sealing tube is located between the edge of the plate and the pressure wall so that when the tube is inflated the edge of the plate forms a localized pressure region along the length of the tube.

12 Claims, 10 Drawing Figures

CONTAINERS HAVING A FLEXIBLE COVER SEALABLE TO A RIGID BASE

BACKGROUND OF THE INVENTION

1. Field of the Invention

This invention relates to containers having a flexible cover sealable to a rigid base.

2. Prior Art

It is known to seal a flexible cover onto a rigid base by means of an inflatable tube. See for example U.S. Pat. Nos. 3,850,214; 4,028,853: 4,114,668; 4,117,575; 4,140,191 and 4,140,237.

Such containers commonly have an impermeable base and the cover is made impermeable. Air may be evacuated from within the cover so that the flexible cover is drawn down onto any goods on the base. This cover thus secures the goods on the base as well as forming a protection preventing the ingress of air or moisture. Such containers can be used therefore not only for the storage of goods but also for the transport of goods.

One convenient way of securing the cover on the base is to form the base with a slot or groove and to provide a flexible inflatable tube along the edge of the flexible cover, the tube being insertable into the slot or groove and inflated so as to be brought into pressure engagement with the walls of the slot or groove. A construction of this kind is described in the specification of U.S. Pat. No. 3,850,214. The inflatable tube may be attached to or integral with the cover or it may be a separate tube, for example housed within the slot or groove or attached to a side wall thereof and serving to seal against the peripheral edge of the cover.

In order to effect a good seal without excessive pressure in the tube, longitudinal ribs or projections may be formed along one side face of the slot or groove. When the tube is inflated, the ribs bite into the tube (or, if the tube is separate from the cover sheet, into the cover sheet between the upturned edge and the inflatable tube) in order to give localised pressure and hence a good seal.

SUMMARY OF THE INVENTION

It is an object of the present invention to provide an improved construction of container which gives good sealing but avoids the necessity of forming longitudinal ribs or projections along a side face of a slot or groove or other pressure member supporting the inflatable tube.

According to this invention, in a container of the kind having a rigid base with a flexible cover sealable to the base by an inflatable tube, the base comprises a rigid support member carrying an impermeable load-supporting plate, the support member having an upwardly-extending pressure wall surrounding and facing inwardly towards the edge of the plate, the pressure wall, over its whole length, having a depth such that it extends from below the level of the plate to above the level of the plate so that the inflatable tube of the seal may be put between the edge of the plate and the pressure wall to have portions lying both above and below said plate whereby, when the tube is inflated, the edge of the plate forms a localised pressure region extending along the whole length of the seal. The inflatable tube may, in the known way, be formed integrally with the cover or secured to the cover. The edge of the plate can then be in direct contact with the tube and thus bites into it when the tube is inflated. Alternatively the peripheral edge of the cover may be put between the inflatable tube and the edge of the plate.

It will be seen in this construction that the edge of the plate forms the necessary biting edge to cause the localised pressure and thereby give the effective seal. The construction is very simple to manufacture.

If the container is to be evacuated, the plate must be air-impermeable and the cover must be air-impermeable, a suitable air-outlet valve being provided in either the cover or the plate. The supporting member need not be air-impermeable; it has to provide a support for the tray and has to provide a rigid backing member to support the inflatable tube with the seal so that the latter is sealed against the edge of the plate. The plate may be, but is not necessarily, fixed to the support. In the case of a transportable container, the support is conveniently formed as a pallet and may have for example openings for the entry of the forks of a fork-lift truck.

The inflatable tube has to be inserted sufficiently far downwardly that, around the whole periphery of the plate, a portion of the tube lies below the level of the plate and a portion lies above the level of the plate. The support member therefore conveniently comprises a plate-supporting portion surrounded by a groove or channel from the outer edge of which the aforementioned pressure wall extends upwardly.

If the inflatable tube is separate from the cover sheet, the pressure wall may be shaped to form a holder for the inflatable tube or may be shaped to receive a holder for the inflatable tube.

The plate may be a flat plate or it may be dished, upwardly or downwardly.

The inflatable tube may be shaped, for example by having a waist adjacent the edge of the plate, so that the tube, when inflated, tends to embrace the peripheral portion of the plate.

DESCRIPTION OF THE PREFERRED EMBODIMENTS

Figure 1:
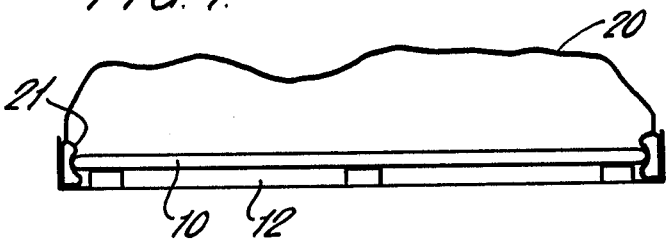
FIG. 1 is a sectional elevation of a container comprising a flexible cover and a base.
Figure 2:
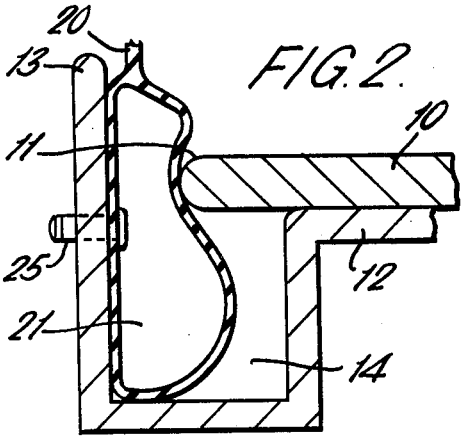
FIG. 2 is a sectional view, to a much larger scale, through part of the seal of the container of FIG. 1.

Referring to FIGS. 1 and 2, there is illustrated a container comprising a flat load-carrying plate 10 formed with a peripheral edge 11 which is rounded in cross-section, this plate resting on a support 12 constituting a base for the container. As is more clearly seen in FIG. 2, the support 12, around its periphery, has an upwardly-extending wall portion 13, the upper edge of which lies above the level of the plate 10. This wall portion 13 extends down below the level of the plate 10, forming the outer wall of a channel 14 extending around the periphery of the base portion. The plate 10 is air-impermeable and may be secured to the support 12 so that it is permanently located in a position where the periphery of the plate extends over part of the top of the channel 14.

The container has a flexible impermeable cover 20, typically a sheet of butyl rubber. In the embodiment illustrated in FIGS. 1 and 2, the cover is formed with an inflatable tube 21 extending around the periphery of the cover and integral therewith. When the container is to be loaded, goods are put on the plate 10 and then the cover is put over these goods, the inflatable tube 21 forming the periphery of the cover being tucked into the slot 14 in such a way that part of the tube lies below the level of the plate 10 and part lies above the level of the plate. The tube is then inflated through a valve 22 and expands so that it presses tightly against the edge of the plate. As seen in FIG. 2 the tube will tend to bulge around the top and the bottom of the plate so giving an efficient and effective seal therewith. The region between the cover and the plate may then be evacuated of air through a valve 25 so that the cover 20 is drawn down onto the goods on the plate, thereby holding them in position.

The inflatable tube 21 may be formed, e.g. by extrusion, to have a waist in the region where it comes in contact with the edge 11 of the plate 10 so thereby helping to ensure that, when inflated, the tube closely embraces the edge of the plate, bulging around the top and bottom sides thereof.

In the known way, to ensure proper insertion of the cover to the required depth in the channel 14, a mark, e.g. a paint mark, may be put around the cover 20 at the required level adjacent the top of the aforementioned pressure wall 13. In another arrangement (not shown), a flap is secured onto the cover around the periphery thereof which flap extends over the top of the wall 13; such a flap assists in enabling the periphery of the cover 20 to be pulled down into the groove 14 to the required depth.

Figure 3:
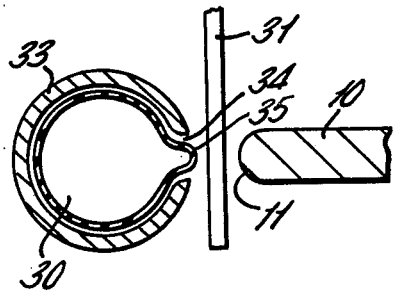
FIG. 3 is a diagrammatic section illustrating an alternative form of seal.

The inflatable tube need not be integral with or attached to the cover although it is preferred to do so as this ensures that the cover is effectively sealed against the edge of the plate. FIG. 3 illustrates a construction having an inflatable tube 30 which is separate from the peripheral portion 31 of the cover. The tube, in this construction, is retained within a holder 33 forming part of or secured to the base support member. This holder has an opening 34 through which a part 35 of the tube protrudes when inflated so as to press against the peripheral portion of the cover forcing this peripheral portion against the edge 11 of the plate 10.

Figure 4:
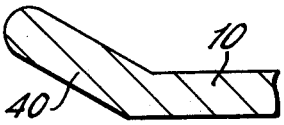
FIG. 4 is a section through part of a modified form of plate for use in the container of FIG. 1.

As shown in FIG. 4, it may be convenient in some cases to make the plate 10 of dished form, the peripheral part of the plate sloping upwardly as shown at 40 in FIG. 4. This construction may be used for example if the base support member is to be formed with a groove 14 which does not extend down to the lowest part of the base. Alternatively the plate may be dished downwardly.

Figure 5A:
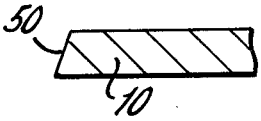
FIGS. 5*a* to 5*f* are sections illustrating various alternative shapes for the edges of a plate used in the container of FIG. 1.
Figure 5B:
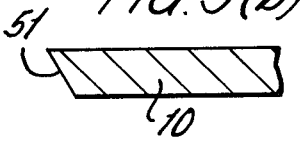
Figure 5C:
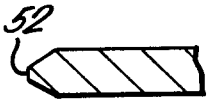
Figure 5D:
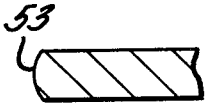
Figure 5E:
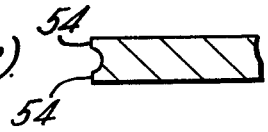
Figure 5F:
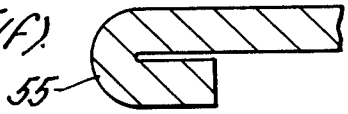

FIGS. 5*a* to 5*f* illustrate various modifications of the shaping of the edge of the plate. As shown at 50 in FIG. 5*a*, the edge may be chamfered to have an acute angle extending along the lower edge of the plate to give a sharp localised pressure against the inflatable tube. FIG. 5*b* illustrates a similar construction in which a sharp edge 51 is formed at the top surface of the plate. In FIG. 5*c* a blunt point 52 is formed around the edge of the plate. In FIG. 5*d* the plate, as shown at 53, is only partially rounded along its edge. FIG. 5*e* shows a construction in which the edge of the plate is shaped at 54 to form two lines of pressure against the inflatable tube. Particularly for a thin plate, the edge of the plate may be turned over to form a "safe edge" as shown at 55 in FIG. 5*f*.

I claim:

1. A container having a rigid base with a flexible cover and an inflatable tube for sealing the cover to the base, wherein the base comprises a rigid support member and an impermeable load-supporting plate carried by said support member, the support member having an upwardly-extending pressure wall surrounding and facing inwardly towards the edge of the plate, which pressure wall over its whole length has a depth such that it extends from below the level of the plate to above the level of the plate so that the inflatable tube of the seal may be put between the edge of the plate and the pressure wall to have portions lying both above and below said plate, whereby when the tube is inflated the edge of the plate forms a localised pressure region extending along the whole length of the seal.

2. A container as claimed in claim 1 wherein the inflatable tube is formed integrally with the cover.

3. A container as claimed in claim 1 wherein the inflatable tube is secured to the cover.

4. A container as claimed in claim 1 wherein the tube is separate from the cover, the peripheral edge of the cover being put between the inflatable tube and the edge of the plate.

5. A container as claimed in claim 1 and adapted to be evacuated wherein the plate is air-impermeable and the cover is air-impermeable and wherein an air outlet valve is provided in either the cover or the plate.

6. A container as claimed in claim 1 wherein said plate is fixed to the support.

7. A container as claimed in claim 1 wherein the support is formed as a pallet.

8. A container as claimed in claim 1 wherein the support member comprises a plate-supporting portion surrounded by a groove or channel, from the outer edge of which groove or channel said pressure wall extends upwardly.

9. A container as claimed in claim 1 and having the inflatable tube separate from the cover sheet, wherein the pressure wall is shaped to form a holder for the inflatable tube or is shaped to receive a holder for the inflatable tube.

10. A container as claimed in claim 1 wherein said plate is a flat plate.

11. A container as claimed in claim 1 wherein said plate is of dished-shape.

12. A container as claimed in claim 1 wherein the inflatable tube is shaped so that the tube when inflated tends to embrace the peripheral portion of the plate.

* * * * *